United States Patent [19]

Sekine

[11] 4,255,803

[45] Mar. 10, 1981

[54] ELECTRONIC TIMEPIECE EQUIPPED WITH ALARM FUNCTION

[75] Inventor: Mitsuo Sekine, Tokorozawa, Japan

[73] Assignee: Citizen Watch Company Limited, Tokyo, Japan

[21] Appl. No.: 921,508

[22] Filed: Jul. 3, 1978

[30] Foreign Application Priority Data

Jul. 6, 1977 [JP] Japan ..... 52-79813
Jul. 9, 1977 [JP] Japan ..... 52-82263

[51] Int. Cl.[3] ..... G04B 23/02
[52] U.S. Cl. ..... 368/72; 368/73; 368/82; 368/243; 368/250; 368/251
[58] Field of Search ..... 58/85.5, 50 R, 57.5, 58/23 R, 16.5, 16 D, 16 R, 19 R, 38 R; 368/72, 73, 82, 243, 250, 251

[56] References Cited

U.S. PATENT DOCUMENTS 4,104,863 8/1978 Kondo ..... 58/16.5 X
4,115,993 9/1978 Moriya ..... 58/57.5 X

*Primary Examiner*—Ulysses Weldon
*Attorney, Agent, or Firm*—Holman & Stern

[57] ABSTRACT

In an electronic timepiece equipped with an alarm function, an alarm time memory circuit is provided for setting in an alarm time by actuation of an external control member and another memory circuit is provided into which an advance warning time period can be set and stored. Means are provided for detecting coincidence between the current time and an advance warning time comprising the difference between the memorized alarm time and the advance warning time period, to provide an advance warning signal prior to the actual alarm time. Parallel computation is used to generate said advance warning time, and the advance warning time period can be continuously displayed.

4 Claims, 2 Drawing Figures

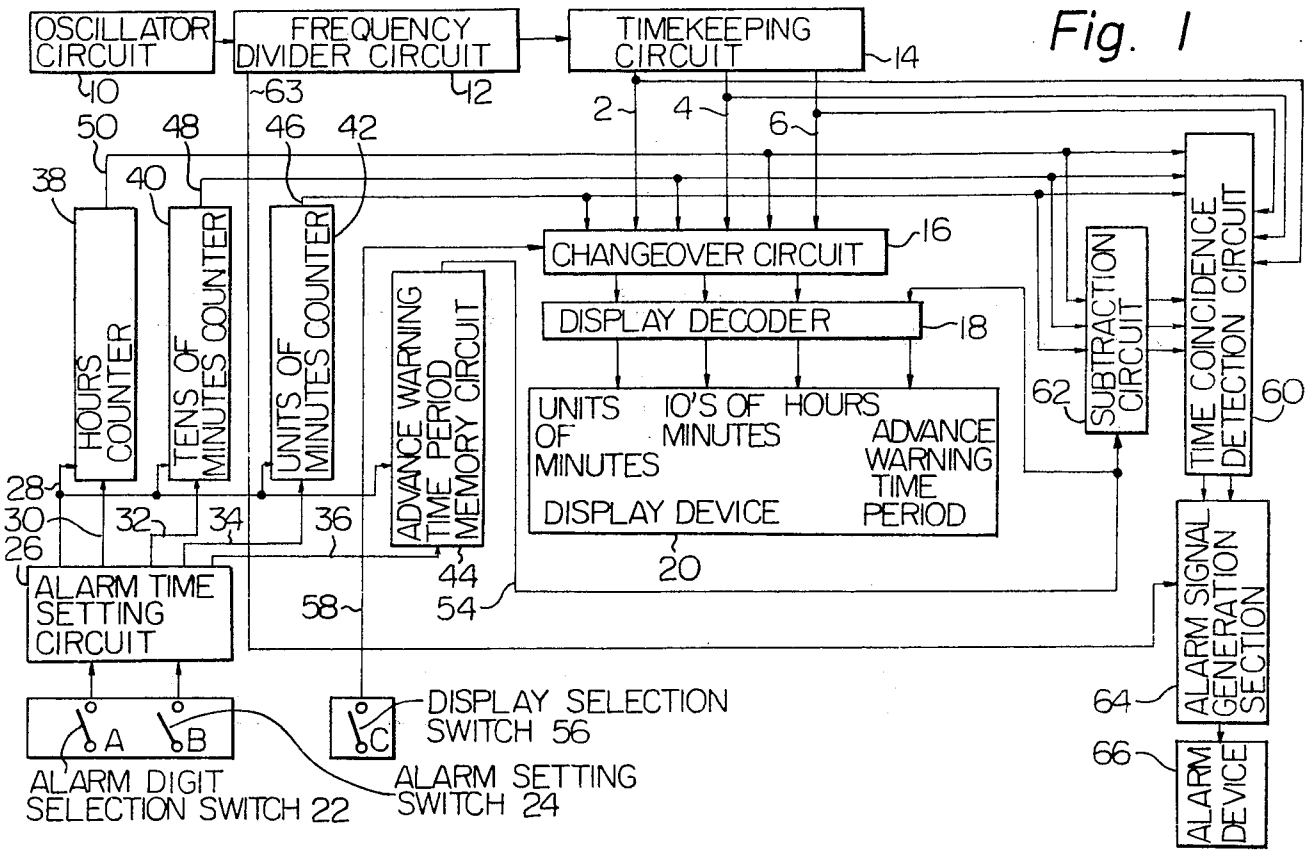
Fig. 1
OSCILLATOR CIRCUIT
FREQUENCY DIVIDER CIRCUIT
TIMEKEEPING CIRCUIT
CHANGEOVER CIRCUIT
DISPLAY DECODER
UNITS OF MINUTES
10'S OF MINUTES
HOURS
ADVANCE WARNING TIME PERIOD
DISPLAY DEVICE
SUBTRACTION CIRCUIT
TIME COINCIDENCE DETECTION CIRCUIT
ALARM SIGNAL GENERATION SECTION
ALARM DEVICE
ADVANCE WARNING TIME PERIOD MEMORY CIRCUIT
UNITS OF MINUTES COUNTER
TENS OF MINUTES COUNTER
HOURS COUNTER
ALARM TIME SETTING CIRCUIT
DISPLAY SELECTION SWITCH 56
ALARM SETTING SWITCH 24
ALARM DIGIT SELECTION SWITCH 22
A
B
C
2
4
6
10
14
16
18
20
26
28
30
32
34
36
38
40
42
44
46
48
50
54
58
60
62
63
64
66

ELECTRONIC TIMEPIECE EQUIPPED WITH ALARM FUNCTION

This invention relates to electronic timepieces equipped with an alarm function, and in particular to an electronic timepiece equipped with an alarm function and with means for providing an advance warning signal to the timepiece user at a point in time prior to an alarm signal being generated, the duration of the advance warning time period being set into the timepiece by the timepiece user.

In an electronic timepiece equipped with an alarm function it is convenient for the timepiece user to have the capability for establishing an advance warning signal to be generated at some point in time prior to an actual alarm time. Previous methods have been proposed for accomplishing this. In such methods, separate circuits are provided for setting in an alarm time and for setting an advance warning time period. For example the alarm time is set into a first memory circuit by means of the alarm time setting circuit and memorized therein. The advanced warning time period setting circuit generates a serial signal which is subtracted from the contents of the first memory circuit by a serial subtraction circuit. The output from this serial subtraction circuit comprises the alarm advance warning time, i.e. this output represents the point in time at which an advance warning signal is to be generated. The output from the serial subtraction circuit is applied to a second memory circuit and stored therein. The advance warning time period is not readily available for display to the timepiece user, and this represents a serious disadvantage of such prior methods. In addition, since it is necessary to provide a second memory circuit to store the hours and minutes information of the advance warning time, the number of circuit elements required is relatively large.

With the method of the present invention, an advance warning time period is set into a memory circuit using the same setting circuit and external operating numbers as are used for the normal alarm time setting. In one method in accordance with the present invention, the output from the advance warning time period memory circuit is subtracted from the memorized alarm time and the result applied to a time coincidence detection circuit, for comparison with the current time which is output from a timekeeping circuit. In another method, the advance warning time period is added to the output from the timekeeping circuit and the result of addition is compared with the memorized alarm time by a time coincidence detection circuit. As a result, coincidence between the current time and an advance warning time (comprising the difference between the alarm time and the advance warning time period) is obtained. At the same time, the memorized alarm time is also compared with the current time by the time coincidence detection circuit. As a result, when coincidence between the advance warning time and the current time is detected an output signal is generated by the coincidence detection circuit and this applied to alarm signal generation means to generate an advance warning signal to the timepiece user.

Subsequently, when coincidence between the current time and the alarm time output from the alarm time memory circuit is detected, an output is again generated from the time coincidence detection circuit. An alarm signal is again produced by the alarm signal generation means to provide the actual alarm signal to the timepiece user.

Since the advance warning time period is stored in a memory circuit, it can be continuously displayed or can be displayed as required by the timepiece user through actuation of an external operating member. Thus, the timepiece user can see the advance warning time period which has been set, at a glance.

It is therefore an object of the present invention to provide an improved electronic timepiece equipped with an alarm function and with means for providing an advance warning signal.

More particularly, it is an object of the present invention to provide an improved electronic timepiece equipped with an alarm function and with means for generating an advance warning signal together with means for memorizing and displaying an advance warning time period which is set in by the user.

Further objects, features and advantages of the present invention will be made more apparent by the following description, when taken in conjunction with the accompanying figures in which:

FIG. 1 is a general block circuit diagram of a first embodiment of an electronic timepiece equipped with an alarm function and means for generating an advance warning system in accordance with the present invention, and;

Figure 2:
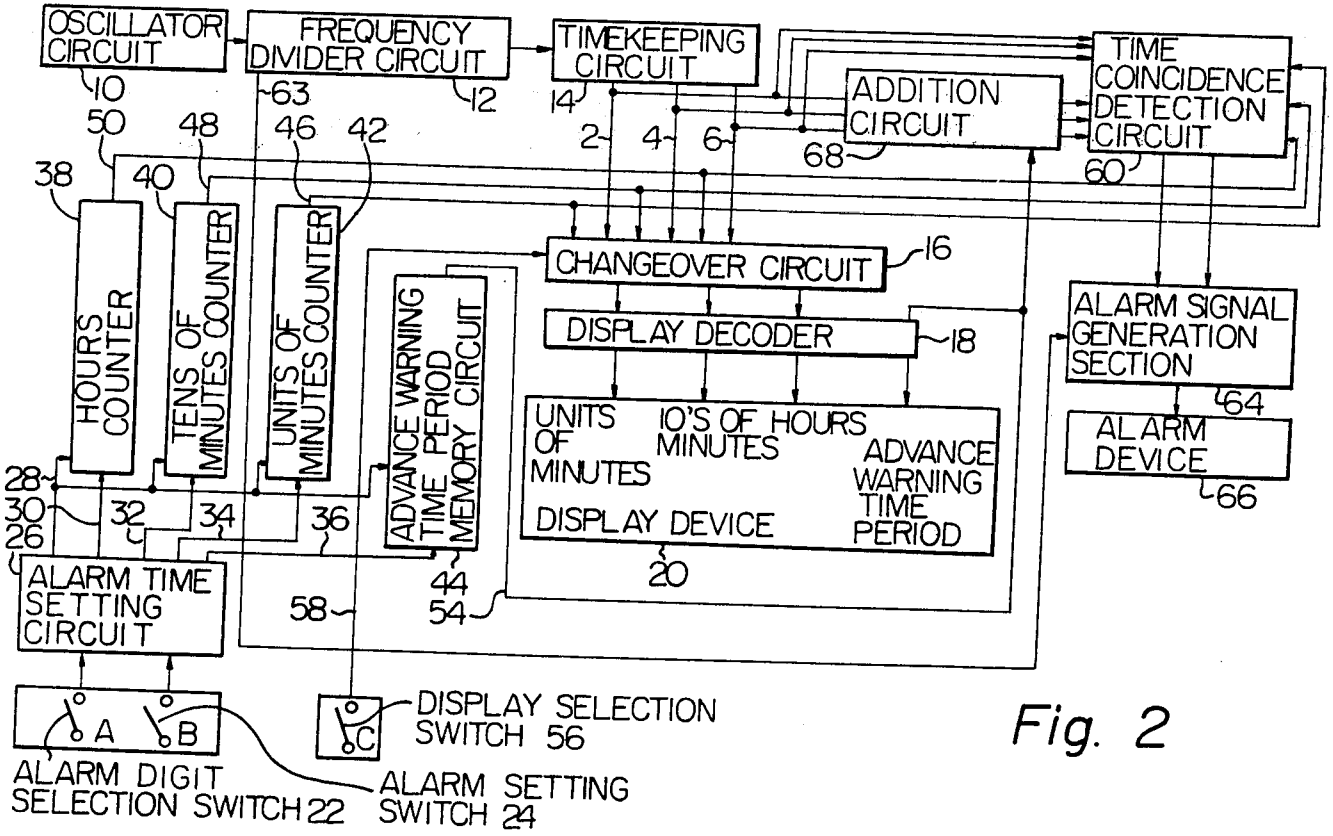
FIG. 2 is a general block circuit diagram of a second embodiment of an electronic timepiece in accordance with the present invention.

Referring now to FIG. 1 the general circuit arrangement of an electronic timepiece in accordance with the present invention is shown in block diagram form. A standard high frequency signal is generated by oscillator circuit 10 and applied to frequency divider circuit 12. Frequency divider circuit 12 produces a standard timekeeping signal which is applied to timekeeping circuit 14. Timekeeping circuit 14 incorporates time counters which count the minutes, tens of minutes, and hours of current time which are output on output lines indicated by numerals 2, 4 and 6. These are applied to changeover circuit 16 to which an alarm time is also input. The alarm time inputs will be described later. The output of changeover circuit 16, which comprises either the current time information from timekeeping circuit 14 or the alarm time information is applied to display decoder 18. Display decoder 18 generates display signal information which is applied to display device 20. Display device 20 serves to display in digital form either the hours, tens of minutes and units of minutes of the current time, or the hours tens of minutes and units of minutes of alarm time in digital form, together with an advance warning time period to be described later. Numeral 22 indicates an alarm digit selection switch which is actuated by an external operating member. A signal from alarm digit selection switch 22 is applied to an alarm time setting circuit 26 to select either of output lines 30, 32, 34 and 36. Numeral 24 indicates an alarm setting switch which is used to generate setting signals by actuation of an external operating member. These setting signals are passed to output line 28 by alarm time setting circuit 26. The setting signal is applied from output line 28 to either hours counter 38, tens of minutes counter 40 units of minutes counter 42 or advance warning time period memory circuit 44 in accordance with selection of output line 30, 32, 34 or 36. Thus by suitably actuation of alarm digit selection switch 22 and alarm setting switch 24, a desired alarm time can be set into counters 38, 40 and 42 and memorized therein. If output line 36 is selected, an advance warning time period can be set into memory circuit 44 by actuation of alarm setting switch 24. If for example it is desired to have an advance warning signal generated 10 minutes before the actual alarm time, this can be done by setting a value of 10 into advance warning time period memory circuit 44.

The units of minutes, tens of minutes and hours of current time information are applied to a time coincidence detection circuit 60 on output lines 2, 4 and 6 of timekeeping circuit 14 respectively. The units of minutes, tens of minutes, and hours of the memorized alarm time are applied to time coincidence detection circuit 60 on output lines 46, 48 and 50 of units of minutes counter 42, tens of minutes counter 40 and hours counter 38 respectively. Comparison between the memorized alarm time and the current time which is measured by timekeeping circuit 14 is thereby accomplished by time coincidence detection circuit 60. The units of minutes, tens of minutes and hours of the memorized alarm time are also applied to a subtraction circuit 62 by output lines 46, 48 and 50. Output line 54 of advance warning time period memory circuit 44 is also applied to subtraction circuit 62. Subtraction circuit 62 subtracts the advance warning time period memorized in advance warning time period memory circuit 44 from the alarm time memorized in alarm time counters 38, 40, and 42. The result of this subtraction comprises the advance warning time, i.e. the hours, tens of minutes and units of minutes of the point in time at which an advance warning signal is to be generated. This advance warning time is applied to time coincidence detection circuit 60 and compared therein with the current time measured by timekeeping circuit 14. Thus, when coincidence occurs between the alarm time which is output by subtraction circuit 62 and the current time measured by timekeeping circuit 14, an output signal is produced by time coincidence detection circuit 60. This output signal is applied to alarm signal generation section 64. An output is thereby produced by alarm signal generation section 64 and is applied to alarm device 66. A warning signal, which can be of audible or visible type is thereby generated by alarm device 66 to provide advance warning to the user that the alarm time is imminent.

Subsequently, when coincidence occurs between the alarm time memorized in alarm time counters 38, 40 and 42, an output is again generated by time coincidence detection circuit 60. Thus, alarm signal generation section 64 again causes alarm device 66 to generate an alarm warning to notify the timepiece user that the alarm time has been attained.

Numeral 56 indicates a display selection switch the output from which controls the operation of changeover circuit 16 to select either the current time which is output from timekeeping circuit 14 or an output lines 2, 4 and 6 or the memorized alarm time which is output from alarm time counters 38, 40 and 42. Thus, by actuation of an external control member coupled to display selection switch 56, the timepiece user can cause either the memorized alarm time or the current time to be displayed on display device 20. In the case of the embodiment described herein, output line 54 of advance warning time period memory circuit 44 is applied directly to display decoder 18 so that the advance warning time period is continuously displayed. It is of course however also possible to apply the output from advance warning time period memory circuit 44 through changeover circuit 16 so that the advance warning time period is only displayed when so required by the timepiece user.

From the above description it will be apparent that the method of the present invention is extremely suitable for an electronic timepiece having an alarm function, since the timepiece user can determine at a glance the advance warning time period which has been memorized. Confusion is thereby avoided with regard to the time remaining after an advance warning signal has been generated until the actual alarm time. In addition, the method of the present invention enables simplification of the timepiece circuitry and a reduction in the number of circuit elements required. This is due to the fact that it is unnecessary to store the hours, tens of minutes and minutes of the advance warning time in a separate memory circuit, due to the use of a subtraction circuit which operates in parallel fashion.

Although alarm time setting and advance warning time period setting is accomplished by steps of a minimum of one minute, other setting steps are possible. For example setting can be preformed in units of seconds or of tens of minutes.

Also, it is possible to provide a different type of warning signal from alarm device 66 depending upon whether an alarm time or an advance warning time is to be notified to the timepiece user.

Referring now to FIG. 2 a second embodiment of the present invention is shown therein. In FIG. 2, circuit blocks and components having the same functions as corresponding blocks or components in FIG. 1 above are indicated by the same numerals as in FIG. 1. For this second embodiment of the present invention, the current time which is output from timekeeping circuit 14 on output lines 2, 4, and 6 is applied to an addition circuit 68, which operates in parallel fashion, as well as to time coincidence detection circuit 60. Output line 54 of advance warning time period memory circuit 44 is also supplied to addition circuit 68. The advance warning time period stored in memory circuit 44 is thereby added to the current time measured by timekeeping circuit 14. The output of addition circuit 68 consists of the hours, tens of minutes and units of minutes of a point in time which is in advance of the current time measured by timekeeping circuit 14 by an amount equal to the advance warning time period. Thus, at a point in time which is in advance of the memorized alarm time by an amount equal to the advance warning time period, coincidence between the output from addition circuit 68 and the alarm time which is applied on lines 46, 48 and 50 to coincidence detection circuit 60 will be detected. An output signal will thereby be generated from time coincidence detection circuit 60 and applied to alarm signal generation section 64. An alarm signal will be produced by alarm device 66 as a result. Thus, the timepiece user receives an advance warning that the memorized alarm time is imminent.

Subsequently, when the current time measured by timekeeping circuit 14 becomes equal to the alarm time stored in alarm time counters 38, 40 and 42. This will be detected by time coincidence detection circuit 60 causing an output signal to be applied to alarm signal generation section 64. An alarm signal will therefore be produced by alarm device 66 to notify the user that the alarm time has been reached.

As in the case of the first embodiment of the present invention described above, the timepiece user can select display of either the memorized alarm time or the current time measured by timekeeping circuit 14 through actuation of display selection switch 56 which controls changeover circuit 16.

An example of the operation of the second embodiment of the present invention will now be given in order to clarify the above description. First, we shall assume that the timepiece user wishes to set an alarm time of 12:00, i.e. 12 o'clock, and to have an advance warning signal generated five minutes prior to the actual alarm time, i.e. at 11:55. First, by actuating alarm setting switch and alarm digit selection switch a value of twelve is set into hours counter 38 and values of zero are set into tens of minutes counter 40 and units of minutes counter 42. Alarm digit selection switch 22 is then actuated once more to select output line 36 of alarm time setting circuit 26. A value of 5, corresponding to 5 minutes of advance warning time period, is now set into counter circuit 44 by the timepiece user actuating alarm setting switch 24. A value of 5 is thereafter continuously output from advance warning time period memory circuit 44 and is added to the current time output from timekeeping circuit 14 on lines 2, 4, and 6 by means of addition circuit 68. When the current time has become 11:55, then the output from addition circuit 68 will become 12:00. This is equal to the alarm time which is memorized in alarm time counters 38, 40 and 42 and this coincidence is detected by time coincidence detection circuit 60. An output will therefore be produced by time coincidence detection circuit 60 and applied to alarm signal generation 64. An advance warning signal will thus be generated by alarm device 66 at 11:55.

After five minutes have elapsed i.e. when the current time has become 12:00, the alarm time which is directly applied to time coincidence detection circuit 60 on lines 46, 48 and 50 will be identical to the current time. Thus, an output will again be generated by time coincidence detection circuit 60 and applied to alarm signal generation section 64. An alarm signal will be generated thereby from alarm device 66, notifying the timepiece user that the alarm time of 12:00 has been reached. At all times prior to the advance warning signal and alarm signal being generated, a value of 5 will be displayed in a designated area of display device 20 to indicate to the timepiece user that an advance warning time period of 5 minutes has been set.

If required, means can be incorporated for automatically halting the alarm signal after a predetermined time or for manual cancellation of the alarm signal by actuation of a switch.

While the present invention has been shown and described with reference to the particular embodiments, it should be noted that various other changes or modifications may be made without departing from the scope of the present invention. For example, alarm signal generation section 64 may be arranged such that audible alarm for an advance warning signal and an actual alarm signal may be different in tone, loudness, sounding frequency etc.

What is claimed is:

1. An electronic timepiece comprising:

means for producing a standard frequency signal;

frequency divider circuit means responsive to said standard frequency signal for producing a time unit signal;

timekeeping circuit means responsive to said time unit signal for producing current time information signals;

alarm time setting circuit means for providing alarm time information setting signals;

display means responsive to said current time information signals and said alarm time information setting signals for selectively displaying a current time information and an alarm time information;

means for storing advance warning time period information in response to one of said alarm time information setting signals;

addition circuit means responsive to said current time information signals from said timekeeping circuit and to output signals from said advance warning time period information storing means for providing an advance warning time information signal;

coincidence detection circuit means for detecting coincidence between said current time information signals and said advance warning time information signal from said addition circuit means for providing an advance alarm signal, and for detecting coincidence between said alarm time information setting signals from said alarm time setting means and said current time information signals to provide an actual alarm signal; and alarm warning means responsive to said advance alarm signal for producing an advance alarm time warning, and responsive to said actual alarm signal for producing an actual alarm time warning.

2. An electronic timepiece according to claim 1, in which said addition circuit means comprises means for adding the contents of said timekeeping circuit means to the contents of said advance warning time period information storing means, to provide said advance warning time information signal.

3. An electronic timepiece according to claim 1, in which said output signals from said advance warning time period storing means are applied to said display means, whereby said advance warning time period information is displayed.

4. An electronic timepiece according to claim 1, and further comprising changeover circuit means coupled to said display means and adapted to receive said current time information signals from said timekeeping circuit means and said alarm time information setting signals from said alarm time setting means, and further comprising switch means responsive to the actuation of an external control member for generating a control signal applied to said changeover circuit means to selectively cause said current time information to be displayed by said display means.

* * * * *